US006244087B1

(12) United States Patent
Blaimschein et al.

(10) Patent No.: US 6,244,087 B1
(45) Date of Patent: Jun. 12, 2001

(54) SWAGING MACHINE

(75) Inventors: Gottfried Blaimschein, Steyr; Alfred Seeber, Garsten/Steyr, both of (AT)

(73) Assignee: GFM Beteiligungs- und Management GmbH & Co. KG

( * ) Notice: Subject to any disclaimer, the term of this patent is extended or adjusted under 35 U.S.C. 154(b) by 0 days.

(21) Appl. No.: 09/456,004

(22) Filed: Dec. 7, 1999

(30) Foreign Application Priority Data

Dec. 7, 1998 (AT) ..... 2050/98

(51) Int. Cl.[7] ..... B21J 7/16
(52) U.S. Cl. ..... 72/76; 72/403
(58) Field of Search ..... 72/76, 402, 403

(56) References Cited

U.S. PATENT DOCUMENTS 279,124 * 6/1883 Brainard ..... 72/76

FOREIGN PATENT DOCUMENTS

916487 * 8/1954 (DE) ..... 72/403

* cited by examiner

*Primary Examiner*—Lowell A. Larson

(74) *Attorney, Agent, or Firm*—Collard & Roe, P.C.

(57) ABSTRACT

A swaging machine (1) comprises hammering units (5) vertically movably guided in radial recesses (4) of a forging box (3) rotatably and drivably mounted about the axis of movement (A) and pressure members supported on a coaxial supporting ring (8) surrounding the forging box (3), where the forging box (3) and/or the supporting ring (8) can be driven so as to rotate relative to each other, and during the respective passage the pressure members act on the hammering units (5) whose head portions protrude into the path of rotation of the pressure members, in the sense of an inwardly directed pressure pulse. To achieve a rugged, hard wearing lifting drive, the pressure members are comprised of a pressure plate (10), which like a rocker is pivotally mounted at a plunger (9) non-rotatably seated in the supporting ring (8) so as to be swivelled in a stop-limited way about a rocking axis (B) parallel to the axis of movement (A), and as head portion the hammering units (5) have a counter-pressure plate (13) associated to the pressure plates (10), which like a rocker can be swivelled in a stop-limited way about a rocking axis (C) parallel to the axis of movement (A), where pressure plates (10) and counter-pressure plates (13) form cooperating slide faces (16, 17) and via restoring springs (18, 19) can be pressurized in the direction of a starting position forwardly inclined with respect to the respective relative rotation (R) of forging box (3) and supporting ring (8).

6 Claims, 2 Drawing Sheets

SWAGING MACHINE

1. Field of the Invention

This invention relates to a swaging machine for swaging rod-shaped or tubular workpieces, comprising hammering units including outer hammering rams and inner hammering tools, which are vertically movably guided in radial recesses of a forging box mounted so as to be rotated and driven about the axis of movement of the workpiece, and comprising pressure members supported at a coaxial supporting ring surrounding the forging box, where the forging box and/or the supporting ring can be driven so as to rotate relative to each other, and the pressure members act on the hammering rams of the hammering units, whose head portions protrude into the path of rotation of the pressure members, during the respective passage in the sense of an inwardly directed pressure pulse.

2. Description of the Prior Art

With a comparatively simple machine concept, these swaging machines provide for swaging with hammering tools radially striking against the workpiece at the same time and rotating relative to the workpiece, whereby an angular displacement of the deformation planes is obtained and zones of increased stress on the material in the overlap region of the hammering tools are avoided. In the known swaging machines pressure rollers serve as pressure members, which rotate in the annular space between forging box and supporting ring and roll over the cam-like head portion of the hammering rams, whereby the hammering units acted upon radially outwardly due to the centrifugal force and/or the spring force are pressed inwards in a pulsed manner, which pressure pulses are transferred to the forging tools and thus to the workpiece as a forming force. Since there is only a line contact, while the pressure rollers act on the ram head portions, and the line of force must extend over these line regions during forging, very high surface pressures occur between ram head portion and pressure rollers, which despite special surface hardenings and the like lead to material overloads with strong wear phenomena and low down-times. There are also difficulties in the adjustment of the vertical position of the hammering units, which adjustment of the vertical position requires a complex insertion of wedge plates or the like between the hammering rams and hammering tools forming separate parts of the hammering units.

SUMMARY OF THE INVENTION

It is therefore the object underlying the invention to create a swaging machine as described above, which is characterized by its rugged and hard wearing lifting drive and in addition offers the prerequisite for an economic adjustment of the vertical position.

This object is solved by the invention in that the pressure members are comprised of a pressure plate which like a rocker is pivotally mounted at the end face of a plunger non-rotatably seated in the supporting ring so as to be swivelled in a stop-limited way about a rocking axis parallel to the axis of movement, and the hammering rams include as head portion a counter-pressure plate associated to the pressure plates, which like a rocker can be swivelled in a stop-limited way about a rocking axis parallel to the axis of movement, where pressure plates and counter-pressure plates form cooperating slide faces and via restoring springs can be pressurized in the direction of a starting position forwardly inclined with respect to the respective relative rotation of forging box and supporting ring. In the case of a relative rotation of forging box and supporting ring, pressure plates and counter-pressure plates act on each other with their slide faces during the respective passage and while simultaneously performing a rocking movement slide on each other, whereby the radial distance of the rocking axes of pressure plate and counter-pressure plate is changed and a lifting movement is forced onto the hammering units against the outwardly directed centrifugal or spring force load thereof. The slide faces of pressure plate and counter-pressure plate resting against each other provide a large-surface contact region, which even with high forming forces does not involve a surface pressure impairing the load-bearing capacity of the material. Since the rocking supports of the pressure plates and counter-pressure plates can also easily be adapted to the occurring loads, there is obtained a rugged, wear-resistant and also highly efficient drive concept. Due to their starting positions each forwardly inclined in relative direction of rotation, the pressure plates and counter-pressure plates each come to properly lie on each other with their slide faces when they are moved towards each other, so that a troublefree movement is ensured. The slide faces have straight generatrixes, which in the case of a central swivel position of the pressure plates and counter-pressure plates with respect to the plungers and hammering rams are aligned tangential to the path of rotation and each lie in a plane normal to the rocking axis, whereby the pressure plates and counter-pressure plates can perfectly slide on each other during passage. It is, however, possible to also provide cylindrical or undulated slide faces instead of planar slide faces in order to increase the contact regions, or to provide the slide faces with rounded edges in direction of rotation, in order to prevent pressure and counter-pressure plates from striking against each other with their edges.

To reduce the pressure loads in the bearing region of the pressure and counter-pressure plates, the pressure plates and the plungers or the counter-pressure plates and the hammering rams each engage in each other with circular cylindrical bearing shells and bearing bodies, so that here as well large-surface contact regions are obtained.

In accordance with a particularly advantageous aspect of the invention the plungers are longitudinally movably inserted in the supporting ring, so that by means of a longitudinal adjustment of these plungers the radial position of the pressure plates with respect to the axis of movement can be changed, which at the same time changes the radial position of the hammering units inside the recesses in the forging box and therefore involves an adjustment of the vertical position. To effect the longitudinal adjustment, all suitable means may be used, preferably screw drives, which via a planetary gear system coaxial to the axis of movement can jointly be actuated and also during a forging operation.

To be able to provide the hammering units with a punch-like design, the hammering rams of the hammering units protrude through the recesses of the forging box and at their end facing the workpiece form a tool holder for positively holding the hammering tool. Since the division of the hammering units into separate rams and hammering tools is no longer necessary to effect an adjustment of the vertical position, positively composed hammering units may be used, which due to their compact design provide for higher blow rates and, since the tools are freely accessible outside the forging box, also simplify the tool change.

Advantageously, the hammering rams are sealed with respect to the recesses by means of peripheral seals, which provides for a sufficient lubrication of the drive and guide members without a risk of contamination.

When the hammering rams in addition have a portion of rectangular cross-section at their head end and a portion of round cross-section at their tool end, the hammering units can properly be sealed without a large constructional effort by means of simple round seals or the like in the vicinity of the tool-end portion, when they are non-rotatably guided by the head-end portion.

BRIEF DESCRIPTION OF THE DRAWING

In the drawing, the subject-matter of the inveniton is represented schematically, wherein.

DESCRIPTION OF THE PREFERRED EMBODIMENT

Figure 1:
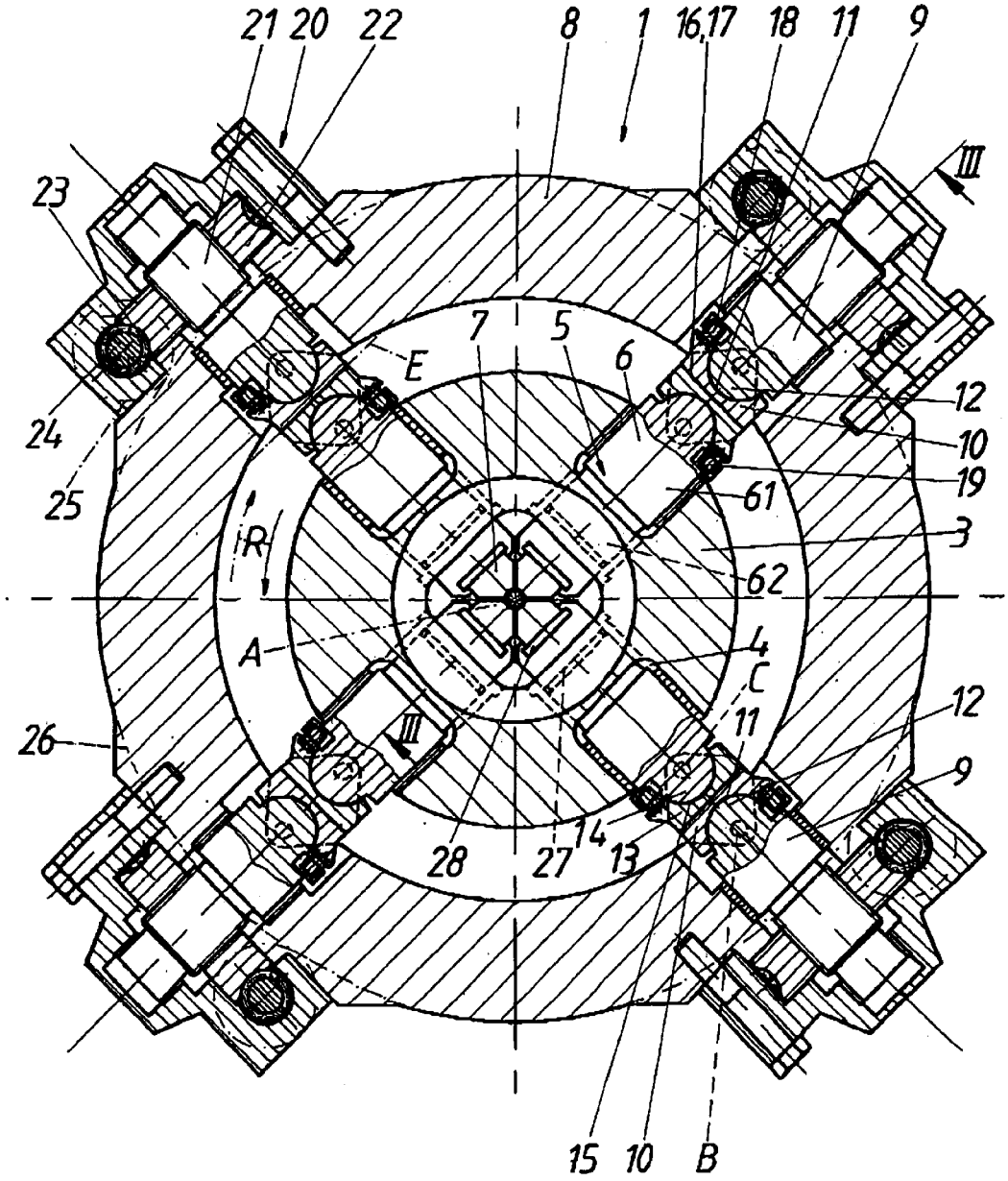
FIG. 1 shows an inventive swaging machine in an axially normal cross-section.
Figure 3:
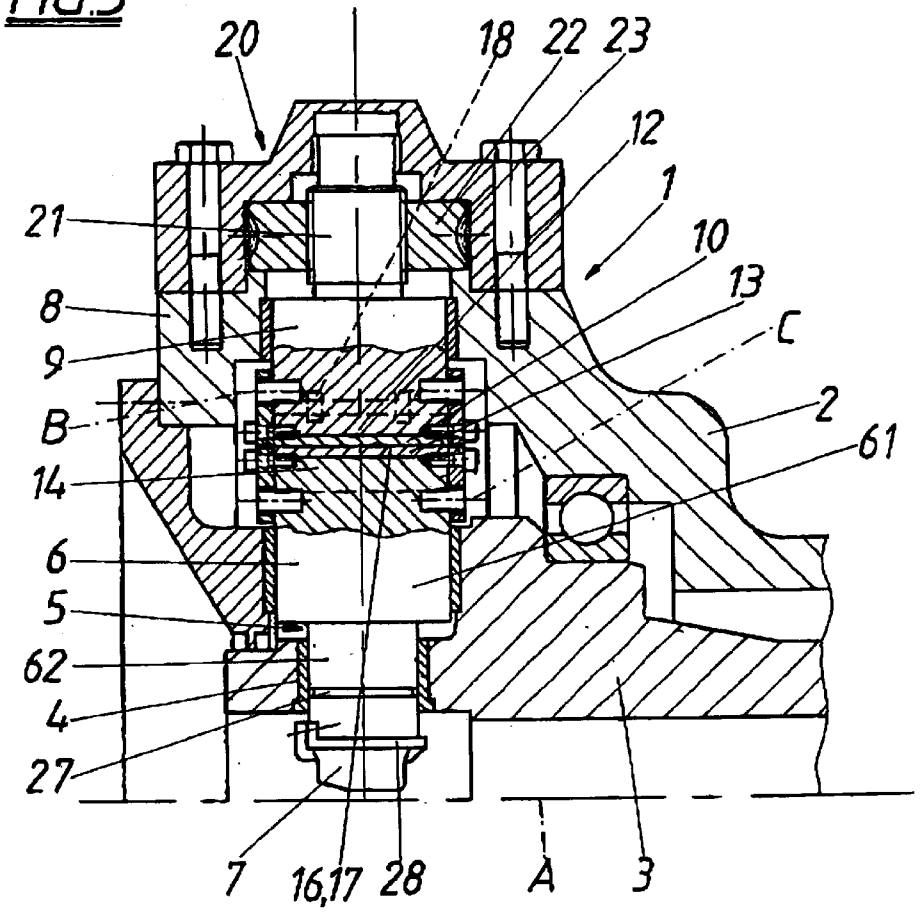
FIG. 3 shows an axial section along line III—III of FIG. 1.

A swaging machine 1 for swaging rod-shaped or tubular workpieces is comprised of a forging box 3 mounted in a machine frame 2 so as to be rotated and driven about the axis of movement A of the workpiece, where in radial recesses 4 of said forging box hammering units 5 including outer forging rams 6 and inner hammering tools 7 are guided so as to be vertically movable. The machine frame 2 forms a supporting ring 8 coaxially surrounding the forging box 3, which supporting ring might also be rotatably and movably mounted in the machine frame as a separate part, and in which supporting ring 8 plungers 9 uniformly distributed around the periphery are non-rotatably seated, where at the end face of said plungers pressure plates 10 are pivotally mounted so as to be swivelled in a stop-limited way about a rocking axis B parallel to the axis of movement A and with a circular cylindrical bearing shell 11 are supported on a corresponding bearing body 12. As head portion, the forging rams 6 of the hammering units 5 have a counter-pressure plate 13 associated to the pressure plates 10, which like a rocker can likewise be swivelled in a stop-limited way about a rocking axis C parallel to the axis of movement, where the ram engages in a corresponding bearing shell 15 of the counter-pressure plate 13 with a cylindrical bearing body 14. Pressure plates 10 and counter-pressure plates 13 form cooperating slide faces 16, 17 of straight generatrixes E aligned in direction of rotation and via restoring springs 18, 19 are loaded in the direction of a starting position forwardly inclined with respect to the respective relative rotation R of forging box 3 and supporting ring 8 (FIG. 2).

Figure 2:
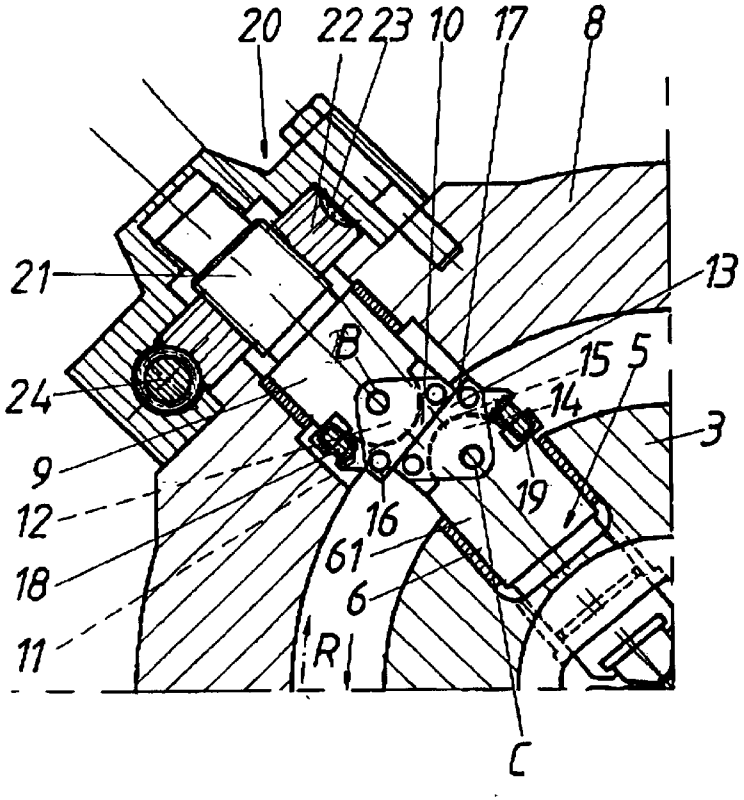
FIG. 2 shows a part of the lifting drive of this machine at the beginning of the forging stroke in the same sectional representation.

When the forging box 3 is rotated by its drive not represented in detail about the axis of movement A, the hammering units 5 are moved radially outwards in a stop-limited way due to the centrifugal force, which opening movement can also be promoted by springs not represented in detail, so that the counter-pressure plates 13 pivotally mounted at the hammering rams 6 protrude into the area of the pressure plates 10 supported at the plungers 9, and pressure plates and counter-pressure plates meet each other in their respective starting positions (FIG. 2.). The slide faces 16, 17 come to lie on each other conformally, and while the hammering units move past the plungers 9 provide for a relative sliding on each other, where together with the sliding movement the pressure plates and counter-pressure plates are swivelled out of the starting position about their rocking axes B, C, until they have reached the central position (FIG. 1) with a radial alignment of the rocking axes B, C, and when swivelling into the final position opposite the starting position loose contact with each other. Due to this rocking movement and the movement of pressure plates and counter-pressure plates past each other, the radial distance between the two rocking axes B, C is changed, so that because of the pressure plates firmly supported in the supporting ring 8 via the plungers the counter-pressure plates 13 must move the hammering units 5 radially inwards, and a pressure pulse is produced, which is transferred as forming force to the forging tools and thus to the workpiece. Since pressure plates and counter-pressure plates have a large-surface contact via the slide faces 16, 17, and the pressure plates and counter-pressure plates are supported on the associated plungers 9 and hammering rams 6 over a large surface via the intermeshing bearing shells 11, 15 and bearing bodies 12, 14, comparatively low surface pressures are obtained even with high pressure pulses, so that a rugged drive concept is obtained, whose cooperating parts are only subjected to a small wear and are characterized by high service lives.

To achieve an adjustment of the vertical position in a simple way, the plungers 9 are inserted in the supporting ring 8 so as to be longitudinally movable and can be adjusted via a screw drive 20, where the plungers 9 have a threaded portion 21 on which an adjusting nut 22 is rotatably seated, which is firmly held in the supporting ring 8. The adjusting nut 22 is provided on its outside with a worm gearing 23 which can be rotated via a worm 24, where a drive gear 25 of said worm is seated on a common shaft parallel to the axis of movement A. These drive gears may each be driven via separate drives or as planetary wheels with a common sun wheel 26, which involves an actuation of the screw drive 20 and thus a positional adjustment of the plunger 9, and therefore inevitably effects a radial adjustment of the hammering units 5 via the cooperating pressure plates 10 and counter-pressure plates 13 and leads to the desired change in the vertical position.

The hammering rams 6 of the hammering units 5 have a portion 61 of rectangular cross-section and a portion 62 of round cross-section, which portion 61 accommodates the pressure plates 13 and is non-rotatably guided in the recesses 4 of the forging box 3, whereas the portion 62 is sealed against the recess 4 by means of a peripheral seal 27 and at its end protruding from the recess has a tool holder 28 for positively inserting the hammering tool 7. There is obtained a punch-like hammering unit with a safe, non-rotatable longitudinal guideway and proper sealing, which involves optimum lubricating conditions without a risk of contamination.

What is claimed is:

1. A swaging machine for swaging a rod-shaped or tubular workpiece, which comprises (a) a forging box rotatably drivable about an axis of movement of the workpiece through the forging box, (b) a supporting ring coaxially surrounding the forging box, the forging box and the supporting ring being rotatable relative to each other, (c) hammering units guided in radial recesses of the forging box for movement towards the axis of movement of the workpiece, each hammering unit including (1) outer hammering rams having a head portion and (2) inner hammering tools, (d) plungers non-rotatably seated in the supporting ring, (e) pressure members acting on the hammering rams, the head portions of the hammering rams protruding into a path of rotation of the pressure members and the pressure members imparting a radially inwardly directed pressure pulse upon the hammering rams when the pressure members pass by the head portions of the hammering rams, the pressure members including (1) a pressure plate pivotally mounted on an end face of the plungers for swivelling in a stop-limited manner about a rocking axis extending parallel to the axis of movement of the workpiece, (f) counter-pressure plates forming the head portions of the hammering rams and being pivotal for swivelling in a stop-limited manner about another rocking axis extending parallel to the axis of movement of the workpiece, (1) the pressure plates and counter-pressure plates forming cooperating slide faces, and (g) restoring springs for biasing the pressure and counter-pressure plates into a starting position which is forwardly inclined in the direction of the rotation of the forging box and supporting ring relative to each other.

2. The swaging machine of claim 1, wherein the pressure plates and the plungers as well as the counter-pressure plates and the hammering rams each engage in each other with cylindrical bearing shells and bearing bodies.

3. The swaging machine of claim 1, wherein the plungers are radially movably inserted in the supporting ring.

4. The swaging machine of claim 1, wherein the hammering rams pass through the recesses of the forging box and comprise tool holders at inner ends thereof for holding the hammering tools.

5. The swaging machine of claim 1, further comprising peripheral seals sealing the hammering rams against the recesses.

6. The swaging machine of claim 1, wherein the hammering rams have a section of rectangular cross-section adjacent the head portion and another section of round cross-section adjacent the inner tools.

* * * * *